US010490324B2

(12) United States Patent
Yamazaki et al.

(10) Patent No.: US 10,490,324 B2
(45) Date of Patent: Nov. 26, 2019

(54) ALLOY FOR R-T-B-BASED RARE EARTH SINTERED MAGNET AND MANUFACTURING METHOD THEREOF, AND MANUFACTURING METHOD OF R-T-B-BASED RARE EARTH SINTERED MAGNET

(71) Applicant: TDK Corporation, Tokyo (JP)

(72) Inventors: Takashi Yamazaki, Chichibu (JP); Kenichiro Nakajima, Chichibu (JP); Akifumi Muraoka, Chichibu (JP)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 15/366,592

(22) Filed: Dec. 1, 2016

(65) Prior Publication Data

US 2017/0162305 A1 Jun. 8, 2017

(30) Foreign Application Priority Data

Dec. 3, 2015 (JP) ..... 2015-236924

(51) Int. Cl.
*H01F 1/055* (2006.01)
*B22F 3/16* (2006.01)
(Continued)

(52) U.S. Cl.
CPC ..... *H01F 1/0557* (2013.01); *B22D 23/00* (2013.01); *B22F 3/16* (2013.01); *B22F 9/04* (2013.01);
(Continued)

(58) Field of Classification Search
None
See application file for complete search history.

(56) References Cited

U.S. PATENT DOCUMENTS 7,090,730 B2 * 8/2006 Nomura ..... H01F 1/0577 148/302
2006/0207689 A1 * 9/2006 Iwasaki ..... H01F 1/0577 148/105
(Continued)

FOREIGN PATENT DOCUMENTS

CN 101888909 A 11/2010
CN 104078176 A 10/2014
(Continued)

OTHER PUBLICATIONS

Permanent Magnet-Material Science and Application by Masato Sagawa, First Edition Second Impression published on Nov. 30, 2008, pp. 256 to 261.
(Continued)

*Primary Examiner* — Xiaowei Su
(74) *Attorney, Agent, or Firm* — Sughrue Mion, PLLC

(57) ABSTRACT

In an alloy for an R-T-B-based rare earth sintered magnet of the present invention formed of a rare earth element R, a transition metal T containing Fe as a main component, a metal element M containing one or more types of metals selected from Al, Ga, and Cu, and B and inevitable impurities, 13 at % to 16 at % of R is contained, 4.5 at % to 6.2 at % of B is contained, 0.1 at % to 2.4 at % of M is contained, the balance is T and the inevitable impurities, a proportion of Dy in the entire rare earth element is 0 at % to 65 at %, Formula 1 described below is satisfied, a main phase containing $R_2Fe_{14}B$ and an alloy grain boundary phase containing more R than the main phase are included, and a distance between the alloy grain boundary phases is greater than or equal to 3 μm and less than or equal to 11 μm.

$0.30 \leq B/TRE \leq 0.37$ (Formula 1)

1 Claim, 4 Drawing Sheets

(51) Int. Cl.

| | |
|---|---|
| ***B22F 9/04*** | (2006.01) |
| ***H01F 41/02*** | (2006.01) |
| ***B22D 23/00*** | (2006.01) |
| ***C21D 6/00*** | (2006.01) |
| ***C22C 38/00*** | (2006.01) |
| ***C22C 38/06*** | (2006.01) |
| ***C22C 38/10*** | (2006.01) |
| ***C22C 38/16*** | (2006.01) |

(52) U.S. Cl.
CPC ..... *C21D 6/007* (2013.01); *C22C 38/002* (2013.01); *C22C 38/005* (2013.01); *C22C 38/06* (2013.01); *C22C 38/10* (2013.01); *C22C 38/16* (2013.01); *H01F 41/0266* (2013.01); *B22F 2301/355* (2013.01); *B22F 2998/10* (2013.01)

(56) References Cited

U.S. PATENT DOCUMENTS

| | | | | |
|---|---|---|---|---|
| 2007/0017601 | A1* | 1/2007 | Miyata | B22F 3/24 148/105 |
| 2011/0025440 | A1* | 2/2011 | Kuniyoshi | C22C 33/0278 335/302 |
| 2012/0091844 | A1* | 4/2012 | Nakajima | C22C 38/005 310/152 |
| 2012/0299675 | A1* | 11/2012 | Honkura | C22C 1/0441 335/302 |
| 2014/0132377 | A1* | 5/2014 | Nakajima | B22F 3/24 335/302 |
| 2014/0290803 | A1* | 10/2014 | Kato | H01F 1/0577 148/302 |
| 2016/0268025 | A1 | 9/2016 | Nagata et al. | |
| 2016/0284452 | A1 | 9/2016 | Horikita et al. | |

FOREIGN PATENT DOCUMENTS

| | | | | |
|---|---|---|---|---|
| CN | 104674115 | A | 6/2015 | |
| JP | 5-112852 | A | 5/1993 | |
| JP | 2002-246215 | A | 8/2002 | |
| JP | 2007-119882 | A | 5/2007 | |
| JP | 2009-231391 | A | 10/2009 | |
| JP | 2009-302318 | A | 12/2009 | |
| JP | WO 2013008756 | A1 * | 1/2013 | B22F 3/24 |
| JP | 2014-169505 | A | 9/2014 | |
| JP | 5613856 | B1 | 10/2014 | |
| JP | 5744286 | B2 | 7/2015 | |
| WO | 2012/002531 | a1 | 1/2012 | |
| WO | 2015/078362 | A1 | 6/2015 | |

OTHER PUBLICATIONS

All of neodymium magnet, Let's save the Earth by rare earths, Masato Sagawa, Agne Gijutsu Center Inc., Apr. 30, 2011.

Communication dated May 3, 2018, issued by the State Intellectual Property Office of People's Republic of China in counterpart Chinese application No. 201611080834.3.

Communication dated Mar. 5, 2019 issued by the Japanese Patent Office in counterpart Japanese application No. 2015-236924.

* cited by examiner

ALLOY FOR R-T-B-BASED RARE EARTH SINTERED MAGNET AND MANUFACTURING METHOD THEREOF, AND MANUFACTURING METHOD OF R-T-B-BASED RARE EARTH SINTERED MAGNET

BACKGROUND OF THE INVENTION

Field of the Invention

The present invention relates to an alloy for an R-T-B-based rare earth sintered magnet and a manufacturing method thereof, and a manufacturing method of an R-T-B-based rare earth sintered magnet.

Priority is claimed on Japanese Patent Application No. 2015-236924, filed on Dec. 3, 2015, the contents of which are incorporated herein by reference.

Description of Related Art

Hitherto, R-T-B-based rare earth sintered magnets (hereinafter, sometimes simply referred to as an "R-T-B-based magnet") have been used in motors such as voice coil motors in hard disc drives and motors for engines in hybrid vehicles or electrical vehicles.

R-T-B-based magnets can be obtained by molding and sintering R-T-B-based alloy powder primarily containing Nd, Fe and B. Generally, in R-T-B-based alloys, R refers to Nd or a substance containing Nd and other rare earth elements such as Pr, Dy and Tb that substitute some of Nd. T refers to Fe or a substance containing Fe and other transition elements such as Co and Ni that substitute some of Fe. B refers to boron, and some of B can be substituted by C or N.

The structure of an ordinary R-T-B-based magnet is mainly made up of a main phase made of $R_2T_{14}B$ and an R-rich phase that is present in the grain boundary of the main phase and has a higher concentration of Nd than the main phase. The R-rich phase is also called a grain boundary phase.

In addition, generally, the composition of an R-T-B-based alloy is set so that Nd, Fe and B are in a ratio as close to $R_2T_{14}B$ as possible in order to increase the proportion of the main phase in the structure of the R-T-B-based magnet (for example, refer to Masato SAGAWA, Permanent Magnet—Material Science and Application—, Pages 256 to 261 of Second Impression of the First Edition published on Nov. 30, 2008).

In addition, there are cases in which R-T-B-based alloys include an $R_2T_{17}$ phase. The $R_2T_{17}$ phase is known as a cause of the degradation of the coercive force or squareness of an R-T-B-based magnet (for example, refer to Japanese Unexamined Patent Application, First Publication No. 2007-119882). Therefore, in a case in which the $R_2T_{17}$ phase is present in an R-T-B-based alloy, the $R_2T_{17}$ phase is removed in a sintering step of producing an R-T-B-based magnet.

In addition, since R-T-B-based magnets used in automobile motors are exposed to a high temperature in the motors, a large coercive force (Hcj) is required.

As a technique to improve the coercive forces of R-T-B-based magnets, there is a technique that substitutes Nd as R in an R-T-B-based alloy with Dy. However, Dy has biased resources and is thus produced only in a limited amount, and therefore it becomes difficult to stably supply Dy. As a result, studies are being made regarding techniques to improve the coercive force of an R-T-B-based magnet without increasing the amount of Dy contained in an R-T-B-based alloy.

In order to improve the coercive force (Hcj) of an R-T-B-based magnet, there is a technique that adds metal elements such as Al, Si, Ga and Sn (for example, refer to Japanese Unexamined Patent Application, First Publication No. 2009-231391). In addition, it is known that Al and Si are incorporated into an R-T-B-based magnet as inevitable impurities as described in Japanese Unexamined Patent Application, First Publication No. 2009-231391. In addition, it is known that, when the amount of Si contained in an R-T-B-based alloy as an impurity exceeds 5%, the coercive force of an R-T-B-based magnet decreases (for example, refer to Japanese Unexamined Patent Application, First Publication No. H5-112852).

In the related art, there were cases in which it was not possible to obtain an R-T-B-based magnet having a sufficiently large coercive force (Hcj) even when metal elements such as Al, Si, Ga and Sn were added to an R-T-B-based alloy. As a result, it was necessary to increase the concentration of Dy even when the metallic elements were added.

The present inventors have studied the composition of the R-T-B-based alloy, and thus, have found that the coercive force reached the maximum at a specific concentration of B. Then, on the basis of the obtained result, the present inventors have succeeded in development of an R-T-B-based alloy which is completely different from the R-T-B-based alloy of the related art, from which an R-T-B-based magnet having a high coercive force can be obtained even in a case where the content of Dy contained in the R-T-B-based alloy is zero or is extremely small (refer to Japanese Patent No. 5613856 and Japanese Patent No. 5744286). The B concentration of the alloy is lower than that of the R-T-B-based alloy of the related art.

An R-T-B-based magnet manufactured by using the R-T-B alloy includes: a main phase that contains $R_2Fe_{14}B$ as a main component; and a grain boundary phase that has a higher R content than the main phase, in which the grain boundary includes a grain boundary phase (transition metal-rich phase) having a lower rare earth element concentration (except for a grain boundary phase (R-rich phase) which is conventionally known to have a high rare earth element concentration) and a higher transition metal element concentration than a grain boundary phase of the related art. An R-T-B-based magnet of the related art includes: a main phase as a magnetic phase that exhibits coercive force; and a grain boundary phase as a non-magnetic phase that is disposed in grain boundaries of the main phase. It is considered that, in the new R-T-B-based magnet developed by the present inventors, the transition metal-rich phase includes a large amount of transition metal and thus exhibits coercive force. The magnet in which the phase exhibiting coercive force ("transition metal-rich phase") is present in the grain boundary phase is revolutionary enough to defy past common knowledge.

The R-T-B-based magnet belongs to a composition range in which a concentration of boron (B) is lower than that of a theoretical composition of $R_2T_{14}B$, and can be manufactured by using an alloy to which a trace amount of a metal element is added. Hereinafter, the R-T-B-based magnet may be referred to as an R-T-B-based magnet containing a low amount of boron.

SUMMARY OF THE INVENTION

However, in the R-T-B-based magnet, as with other magnets, a high orientation rate is required in addition to a high coercive force (Hcj). Here, the orientation rate is a value obtained by dividing Br by Js. Br is remanence, and Js is saturated magnetization.

The present invention has been made in consideration of the circumstances described above, and an object of the present invention is to provide an alloy for an R-T-B-based rare earth sintered magnet from which an R-T-B-based magnet having a high orientation rate along with a high coercive force can be manufactured and a manufacturing method thereof, and a manufacturing method of an R-T-B-based rare earth sintered magnet.

In order to attain the object described above, the following means are adopted in the present invention.

(1) An alloy for an R-T-B-based rare earth sintered magnet formed of a rare earth element R, a transition metal T containing Fe as a main component, a metal element M containing one or more types of metals selected from Al, Ga, and Cu, and B and inevitable impurities, in which 13 at % to 16 at % of R is contained, 4.5 at % to 6.2 at % of B is contained, 0.1 at % to 2.4 at % of M is contained, the balance is T and the inevitable impurities, a proportion of Dy in the entire rare earth element is 0 at % to 65 at %, Formula 1 described below is satisfied, a main phase containing $R_2Fe_{14}B$ and an alloy grain boundary phase containing more R than the main phase are included, and a distance between the alloy grain boundary phases is greater than or equal to 3 μm and less than or equal to 11 μm.

$$0.30 \leq B/TRE \leq 0.37 \quad \text{(Formula 1)}$$

In Formula 1, B represents a concentration (at %) of a boron element, and TRE represents a total concentration (at %) of the rare earth elements.

(2) A manufacturing method of an alloy for an R-T-B-based rare earth sintered magnet, including: a casting step of casting a molten alloy formed of a rare earth element R, a transition metal T containing Fe as a main component, a metal element M containing one or more types of metals selected from Al, Ga, and Cu, B and inevitable impurities, in which 13 at % to 16 at % of R is contained, 4.5 at % to 6.2 at % of B is contained, 0.1 at % to 2.4 at % of M is contained, the balance is T and the inevitable impurities, a proportion of Dy in the entire rare earth element is 0 at % to 65 at %, and Formula 1 described below is satisfied, and manufacturing of a cast alloy; and a heat treatment step of performing heat treatment with respect to the cast alloy at a temperature of 600° C. to 1000° C.

$$0.30 \leq B/TRE \leq 0.37 \quad \text{(Formula 1)}$$

In Formula 1, B represents a concentration (at %) of a boron element, and TRE represents a total concentration (at %) of the rare earth elements.

(3) The manufacturing method of an alloy for an R-T-B-based rare earth sintered magnet according to (2), in which the heat treatment step is performed in a vacuum atmosphere or an inert gas atmosphere.

(4) The manufacturing method of an alloy for an R-T-B-based rare earth sintered magnet according to (2) or (3), in which the heat treatment step is performed for 20 minutes to 10 hours.

(5) A manufacturing method of an R-T-B-based rare earth sintered magnet, including: a casting step of casting a molten alloy formed of a rare earth element R, a transition metal T containing Fe as a main component, a metal element M containing one or more types of metals selected from Al, Ga, and Cu, B and inevitable impurities, in which 13 at % to 16 at % of R is contained, 4.5 at % to 6.2 at % of B is contained, 0.1 at % to 2.4 at % of M is contained, the balance is T and the inevitable impurities, a proportion of Dy in the entire rare earth element is 0 at % to 65 at %, and Formula 1 described below is satisfied, and manufacturing of a cast alloy; a heat treatment step of performing heat treatment with respect to the cast alloy at a temperature of 600° C. to 1000° C., and of manufacturing an alloy for an R-T-B-based rare earth sintered magnet; a pulverizing step of pulverizing the alloy for an R-T-B-based rare earth sintered magnet; a molding step of molding the pulverized alloy for an R-T-B-based rare earth sintered magnet, and of obtaining a molded body; and a sintering step of sintering the molded body.

$$0.30 \leq B/TRE \leq 0.37 \quad \text{(Formula 1)}$$

In Formula 1, B represents a concentration (at %) of a boron element, and TRE represents a total concentration (at %) of the rare earth elements.

(6) A manufacturing method of an R-T-B-based rare earth sintered magnet, including: a pulverizing step of pulverizing the alloy for an R-T-B-based rare earth sintered magnet according to (1); a molding step of molding the pulverized alloy for an R-T-B-based rare earth sintered magnet, and of obtaining a molded body; and a sintering step of sintering the molded body.

According to an alloy for an R-T-B-based rare earth sintered magnet of the present invention, it is possible to provide an R-T-B-based magnet having a high orientation rate along with a high coercive force.

DETAILED DESCRIPTION OF THE INVENTION

Figures 1A, 1B, 1C:
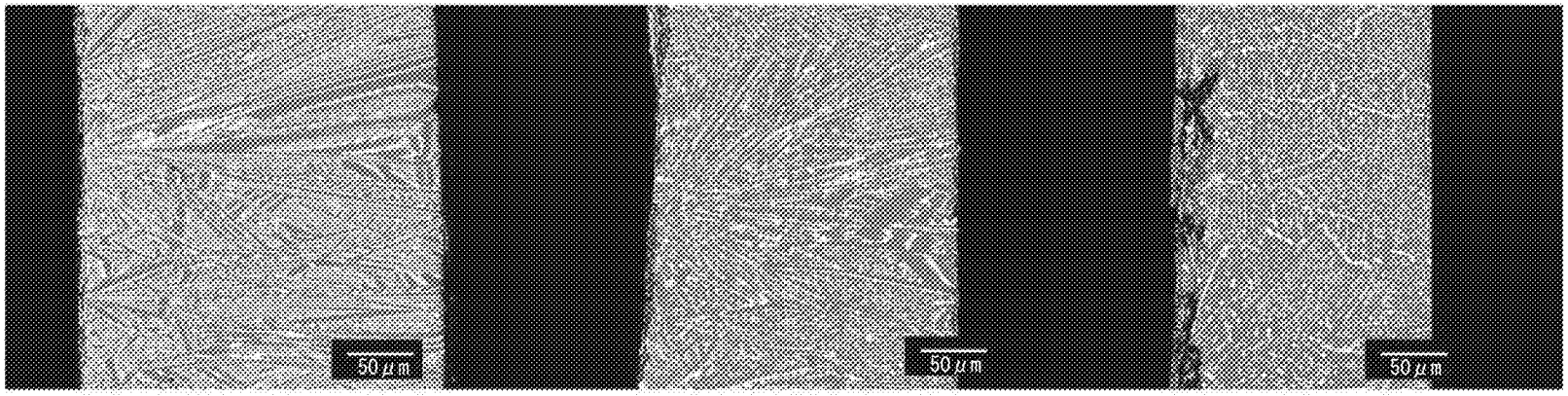
FIGS. 1A to 1E are backscattered electron images obtained by imaging a sectional surface of an R-T-B-based alloy having a composition of an alloy A at a magnification of 350 times with an electron microscope.

Hereinafter, an embodiment of the present invention will be described in detail. The present invention is not limited to the embodiment described below, and can be suitably changed within a range not changing the gist thereof.

Furthermore, herein, a "cast alloy" indicates an alloy obtained by casting a molten alloy, for example, according to a strip cast method. In the present invention, an "alloy for an R-T-B-based rare earth sintered magnet" of an "alloy for an R-T-B-based rare earth sintered magnet and a manufacturing method thereof" indicates an alloy obtained by performing a heat treatment step with respect to the "cast alloy" (also including a cast alloy flake) before being subjected to sintering for manufacturing a sintered magnet.

Alloy for R-T-B-Based Rare Earth Sintered Magnet

An alloy for an R-T-B-based rare earth sintered magnet of an embodiment of the present invention (hereinafter, there is a case where the alloy for an R-T-B-based rare earth sintered magnet is simply referred to as an "R-T-B-based alloy") is formed of a rare earth element R, a transition metal T containing Fe as a main component, a metal element M containing one or more types of metals selected from Al, Ga, and Cu, and B and inevitable impurities. In the R-T-B-based alloy, 13 atomic present (at %) to 16 at % of R is contained, 4.5 at % to 6.2 at % of B is contained, 0.1 at % to 2.4 at % of M is contained, and the balance is T and the inevitable impurities. In the R-T-B-based alloy, a proportion of Dy in the entire rare earth element is 0 at % to 65 at %. In the R-T-B-based alloy, Formula 1 described below is satisfied, and a main phase containing $R_2Fe_{14}B$ and an alloy grain boundary phase containing more R than the main phase are included. In the R-T-B-based alloy, a distance between the alloy grain boundary phases is greater than or equal to 3 μm and less than or equal to 11 μm.

$$0.30 \leq B/TRE \leq 0.37 \quad \text{(Formula 1)}$$

In Formula 1, B represents a concentration (at %) of a boron element, and TRE represents a total concentration (at %) of the rare earth elements.

Furthermore, herein, in order to distinguish the grain boundary phase of the R-T-B-based alloy from a grain boundary phase of an R-T-B-based magnet, the grain boundary phase of the R-T-B-based alloy will be referred to as an "alloy grain boundary phase".

In a case where the content of R contained in the R-T-B-based alloy is less than 13 at %, a coercive force of an R-T-B-based magnet obtained by using the R-T-B-based alloy becomes insufficient. In addition, in a case where the content of R is greater than 16 at %, remanence of the R-T-B-based magnet obtained by using the R-T-B-based alloy decreases, and thus, the R-T-B-based magnet is not suitable as a magnet.

The content of Dy in the entire rare earth element of the R-T-B-based alloy is greater than or equal to 0 at % and less than or equal to 65 at %. In the R-T-B-based magnet which is manufactured by using the R-T-B-based alloy of the present invention, the coercive force is improved by including a transition metal-rich phase, and thus, Dy need not be contained, and even in a case where Dy is contained, a sufficiently high coercive force improving effect can be obtained at a content of less than or equal to 65 at %.

Examples of the rare earth element of the R-T-B-based alloy other than Dy include Sc, Y, La, Ce, Pr, Nd, Pm, Sm, Eu, Gd, Tb, Ho, Er, Tm, Yb, and Lu, and among them, Nd, Pr, and Tb are particularly preferably used. In addition, it is preferable that R of the R-T-B-based alloy contain Nd as a main component.

In addition, B contained in the R-T-B-based alloy is boron, and a part thereof can be substituted with C or N. The content of B is greater than or equal to 4.5 at % and less than or equal to 6.2 at %, and satisfies Formula 1 described above. It is preferable that the content of B be greater than or equal to 4.8 at %. It is more preferable that the content of B be less than or equal to 5.5 at %. In a case where the content of B contained in the R-T-B-based alloy is less than 4.5 at %, the coercive force of the R-T-B-based magnet obtained by using the R-T-B-based alloy becomes insufficient. In a case where the content of B exceeds the range of Formula 1 described above, it is not possible to obtain an effect of improving an orientation rate.

In addition, T contained in the R-T-B-based alloy is a transition metal containing Fe as a main component. Various elements from group III to group XI can be used as the transition metal contained in T of the R-T-B-based alloy other than Fe. In a case where T of the R-T-B-based alloy contains Co other than Fe, it is preferable since a Curie temperature (Tc) can be improved.

It is assumed that the metal element M contained in the R-T-B-based alloy of the present invention accelerates the generation of the transition metal-rich phase in a step of temporarily slowing a cooling rate of a cast alloy flake which is performed as necessary at the time of manufacturing the R-T-B-based alloy (a temperature-retaining step of the cast alloy), or in sintering for manufacturing the R-T-B-based magnet and in heat treatment which is performed after the sintering as necessary. The metal element M contains one or more types of metals selected from Al, Ga, and Cu, 0.1 at % to 2.4 at % of the metal element M is contained in the R-T-B-based alloy.

In the R-T-B-based alloy of the present invention, 0.1 at % to 2.4 at % of the metal element M is contained, and thus, it is possible to obtain an R-T-B-based magnet including an R-rich phase and a transition metal-rich phase by sintering the R-T-B-based alloy.

One or more types of metals selected from Al, Ga, and Cu, which are contained in the metal element M, do not affect other magnetic properties, but effectively improve a coercive force (Hcj) by accelerating the generation of the transition metal-rich phase in the temperature-retaining step of the cast alloy, or in the sintering and the heat treatment of the R-T-B-based magnet.

In a case where the content of the metal element M is less than 0.1 at %, an effect of accelerating the generation of the transition metal-rich phase becomes insufficient, and the transition metal-rich phase is not formed in the R-T-B-based magnet. Therefore, it is not possible to sufficiently improve the coercive force (Hcj) of the R-T-B-based magnet. In addition, in a case where the content of the metal element M is greater than 2.4 at %, magnetic properties of the R-T-B-based magnet such as remanence (Br) or a maximum energy product (BHmax) decrease. It is preferable that the content of the metal element M be greater than or equal to 0.7 at %. It is more preferable that the content of the metal element M be less than or equal to 1.4 at %.

In a case where Cu is contained in the R-T-B-based alloy, it is preferable that the concentration of Cu be 0.07 at % to 1 at %. In a case where the concentration of Cu is less than 0.07 at %, it is difficult to sinter the magnet.

In addition, in a case where the concentration of Cu is greater than 1 at %, it is not preferable since the remanence (Br) of the R-T-B-based magnet decreases.

In addition, in a case where the total concentration of oxygen, nitrogen, and carbon contained in the R-T-B-based alloy is high, in a step of sintering the R-T-B-based magnet, the elements described above and the rare earth element R are combined, and thus, the rare earth element R is consumed. For this reason, in the rare earth element R contained in the R-T-B-based alloy, the amount of rare earth element R used as a raw material of the transition metal-rich phase decreases in heat treatment after the R-T-B-based magnet is obtained by being sintered. As a result, a generated amount of the transition metal-rich phase decreases, and thus, the coercive force of the R-T-B-based magnet becomes insufficient. Therefore, it is preferable that the total concentration of oxygen, nitrogen, and carbon contained in the R-T-B-based alloy be less than or equal to 0.5 wt %. By setting the total concentration to be less than or equal to the concentration described above, it is possible to effectively improve the coercive force (Hcj) by suppressing the consumption of the rare earth element R.

The R-T-B-based alloy of the present invention includes the main phase mainly containing $R_2Fe_{14}B$, and an alloy grain boundary phase containing more R than the main phase, and the distance between the alloy grain boundary phases is greater than or equal to 3 μm and less than or equal to 11 μm. The distance between the alloy grain boundary phases is more preferably greater than or equal to 4.5 μm and less than or equal to 10 μm, and is even more preferably greater than or equal to 6 μm and less than or equal to 9 μm. The alloy grain boundary phase can be observed by a backscattered electron image of an electron microscope. An alloy grain boundary phase formed only of R and an alloy grain boundary phase containing R-T-M substantially exist in the alloy grain boundary phase.

In a cast alloy which is manufactured by casting a molten alloy satisfying the composition of the R-T-B-based alloy of the present invention, it is general that the distance between the alloy grain boundary phases is less than a range of greater than or equal to 3 μm and less than or equal to 11 μm. Thus, in a case where a particle diameter of an alloy structure is micronized, there is an advantage in that pulverizability is improved, grain boundary phases are evenly distributed in an R-T-B-based magnet manufactured by using the alloy structure, and an excellent coercive force can be obtained.

However, in an R-T-B-based magnet manufactured by using such a cast alloy, there is a case where the orientation rate is less than or equal to 93%, and even in a case where the orientation rate is greater than or equal to 93%, it is usual that the orientation rate is not greater than 94%. Practically, the orientation rate of the R-T-B-based magnet is approximately 94%, and there are many cases where the orientation rate of the R-T-B-based magnet is preferably greater than or equal to 94%. Therefore, even in an R-T-B-based magnet containing a low amount of boron, such an orientation rate is obtained.

In a case where an R-T-B-based alloy satisfying the composition of the R-T-B-based alloy of the present invention satisfying Formula 1 described above is manufactured, an $R_2T_{17}$ phase is easily generated in the alloy. It is known that the $R_2T_{17}$ phase causes a decrease in the coercive force or the squareness of the R-T-B-based magnet, and thus, in general, the R-T-B-based alloy is manufactured under conditions where the $R_2T_{17}$ phase is not generated. However, in the present invention, it is considered that the $R_2T_{17}$ phase becomes the raw material of the transition metal-rich phase in a manufacturing step of an R-T-B-based alloy and/or a manufacturing step of an R-T-B-based magnet.

In the R-T-B-based alloy of the present invention, an area proportion of a region including the $R_2T_{17}$ phase is preferably 0.1% to 30%, and is more preferably 0.1% to 20%. In a case where the area proportion of the region including the $R_2T_{17}$ phase is in the range described above, the generation of the transition metal-rich phase is effectively accelerated, and an R-T-B-based magnet having a high coercive force which sufficiently includes the transition metal-rich phase can be obtained. In a case where the area proportion of the region including the $R_2T_{17}$ phase is greater than or equal to 30%, in the manufacturing step of the R-T-B-based magnet, it is not possible to completely consume the $R_2T_{17}$ phase, and thus, there is a case where the coercive force or the squareness of the R-T-B-based magnet decreases.

Further, in the R-T-B-based alloy of the present invention, in a case where the area proportion of the region including the $R_2T_{17}$ phase is 0.1% to 30%, extremely excellent pulverizability can be obtained. This is because the $R_2T_{17}$ phase is brittle compared to an $R_2T_{14}B$ phase.

The area proportion of the region including the $R_2T_{17}$ phase is obtained by observing a sectional surface of a cast alloy flake which becomes an R-T-B-based alloy with a microscope. Specifically, the area proportion of the region including the $R_2T_{17}$ phase is obtained by the following procedure.

The cast alloy flake is embedded in a resin, is machined in a thickness direction of the cast alloy flake, and is subjected to mirror polishing, and then, is subjected to vapor deposition with gold or carbon in order to apply conductivity. Therefore, an observation sample is obtained. A backscattered electron image of the sample is imaged at a magnification of 350 times with an electron scanning microscope.

Manufacturing Method of Alloy for R-T-B-Based Rare Earth Sintered Magnet

A manufacturing method of an alloy for an R-T-B-based rare earth sintered magnet of the present invention includes a casting step of casting a molten alloy formed of a rare earth element R, a transition metal T containing Fe as a main component, a metal element M containing one or more types of metals selected from Al, Ga, and Cu, B and inevitable impurities, in which 13 at % to 16 at % of R is contained, 4.5 at % to 6.2 at % of B is contained, 0.1 at % to 2.4 at % of M is contained, the balance is T and the inevitable impurities, a proportion of Dy in the entire rare earth element is 0 at % to 65 at %, and (Formula 1) described below is satisfied, and manufacturing of a cast alloy, and a heat treatment step of performing heat treatment with respect to the cast alloy at a temperature of 600° C. to 1000° C.

$$0.30 \leq B/TRE \leq 0.37 \quad \text{(Formula 1)}$$

In Formula 1, B represents a concentration (at %) of a boron element, and TRE represents a total concentration (at %) of the rare earth elements.

The casting step of the present invention can be performed by a known method. That is, for example, a molten alloy having a predetermined composition may be cast at a temperature of approximately 1450° C., and a cast alloy flake may be manufactured, for example, by a strip cast (SC) method.

In the heat treatment step of the present invention, the cast alloy is subjected to heat treatment at a temperature of higher than or equal to 600° C. and lower than or equal to 1000° C. The heat treatment temperature is more preferably 650° C. to 900° C., and is even more preferably 700° C. to 850° C. This is because in a case where the heat treatment temperature is lower than 600° C., repositioning of atoms for widening the distance between the alloy grain boundary phases does not sufficiently occur. In addition, this is because in a case where the heat treatment temperature is higher than 1000° C., the alloy structure is excessively coarsened, and thus, the pulverizability deteriorates.

The heat treatment step of the present invention can be performed by a known method.

It is preferable that the heat treatment step be performed in a vacuum atmosphere or an inert gas atmosphere.

This is because it is possible to avoid a reaction with atmosphere gas in the heat treatment step.

In the heat treatment step, it is preferable that a time for performing the heat treatment be in a range of longer than or equal to 20 minutes and shorter than or equal to 10 hours. The heat treatment time is more preferably 20 minutes to 3 hours, and is even more preferably 30 minutes to 2 hours.

This is because in a case where the heat treatment time is shorter than 20 minutes, the repositioning of the atoms for widening the distance between the alloy grain boundary phases does not sufficiently occur. In addition, this is because in a case where the heat treatment time is longer than 10 hours, an effect of widening the distance between the alloy grain boundary phases is saturated.

An effect obtained by performing the heat treatment step is according to multiplication between the temperature and the time, and thus, in general, in a case where the temperature is high, the time may be comparatively short, and in a case where the temperature is low, the time may be comparatively long.

The heat treatment step widens the distance between the alloy grain boundary phases compared to a case where the heat treatment step is not performed, and thus, is for improving an orientation rate of a magnet manufactured by using the alloy. For this reason, it is preferable that the temperature and the time of the heat treatment step be selected such that the orientation rate is maximized.

The heat treatment step may be performed at any time insofar as the heat treatment step is performed after the casting step is performed and before the cast alloy is pulverized.

Furthermore, in the casting step of the manufacturing method of an R-T-B-based alloy, it is known that a temperature-retaining step of maintaining the manufactured cast alloy at a constant temperature for 10 seconds to 120 seconds is performed until the cast alloy at a temperature of higher than 800° C. is cooled to a temperature of lower than 500° C. (for example, Japanese Unexamined Patent Application, First Publication No. 2014-205918). The temperature-retaining step is performed for a short period of time of approximately 10 seconds to 120 seconds, and the conditions thereof are considerably different from those of the heat treatment step of the present invention.

A mechanism in that the orientation rate of the magnet is improved by performing such a heat treatment step or by widening the distance between the alloy grain boundary phases is not apparent at the present time. At first, the distance between the alloy grain boundary phases affects the shape at the time of forming a powder, and thus, only the shape of the powder is considered. However, in the R-T-B-based magnet of the related art (not the R-T-B-based magnet containing a low amount of boron), even in a case where the distance between the alloy grain boundary phases is widened by the heat treatment, the orientation rate is rarely changed (refer to FIG. 6 and FIG. 7). Therefore, the improvement in the orientation rate in a case where the distance between the alloy grain boundary phases is widened is a phenomenon specific to the R-T-B-based magnet containing a low amount of boron.

Figures 1D, 1E:
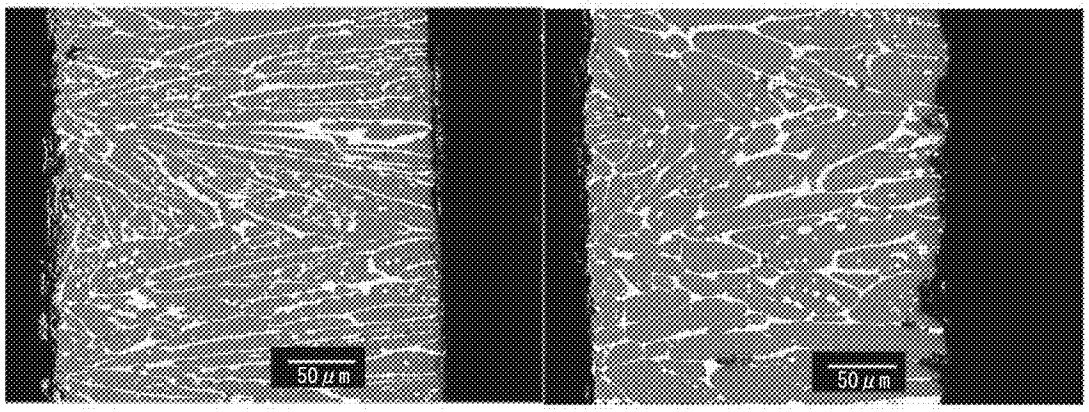

FIGS. 1A to 1E illustrate backscattered electron images obtained by imaging a sectional surface of an R-T-B-based alloy having a composition of an alloy A described below at a magnification of 350 times with an electron microscope. FIG. 1A is the backscattered electron image of the electron microscope of the R-T-B-based alloy to which the heat treatment step is not performed, FIG. 1B is the backscattered electron image of the electron microscope of the R-T-B-based alloy to which the heat treatment step is performed at 600° C. for 3 hours, FIG. 1C is the backscattered electron image of the electron microscope of the R-T-B-based alloy to which the heat treatment step is performed at 700° C. for 2 hours, FIG. 1D is the backscattered electron image of the electron microscope of the R-T-B-based alloy to which the heat treatment step is performed at 800° C. for 30 minutes, and FIG. 1E is the backscattered electron image of the electron microscope of the R-T-B-based alloy to which the heat treatment step is performed at 1000° C. for 30 minutes.

In the images, a grey $R_2T_{14}B$ phase and a white linear alloy grain boundary phase are observed.

The backscattered electron image of the electron microscope is obtained by the following procedure.

The cast alloy flake is embedded in a resin, is machined in the thickness direction of the cast alloy flake, and is subjected to mirror polishing, and then, is subjected to vapor deposition with gold in order to apply conductivity. Therefore, an observation sample is obtained. A-backscattered electron image of the sample is imaged at a magnification of 350 times with an electron scanning microscope.

In FIGS. 1A to 1E, the distance between the alloy grain boundary phases in FIG. 1A is 2.4 μm, the distance between the alloy grain boundary phases in FIG. 1B is 3.9 μm, the distance between the alloy grain boundary phases in FIG. 1C is 5.1 μm, the distance between the alloy grain boundary phases in FIG. 1E is 7.8 μm, and the distance between the alloy grain boundary phases in FIG. 1E is 10.5 μm. From the backscattered electron images of FIGS. 1A to 1E, a difference in the distances between the alloy grain boundary phases is apparent. The distance between the alloy grain boundary phases is calculated by the following procedure.

First, a threshold value of brightness for distinguishing the main phase from the alloy grain boundary phase is determined on the basis of the backscattered electron image. Next, a straight line is drawn on the backscattered electron image in a direction perpendicular to a cooling direction of the alloy. Then, a graph of brightness distribution in a portion where the straight line is drawn is prepared. Next, the number of times in which the brightness of the graph becomes greater than or equal to the threshold value is obtained. The number of times corresponds to the number of times in which the straight line crosses over the alloy grain boundary phase. After that, the length of the straight line is divided by the number of times, and thus, the distance between the alloy grain boundary phases is obtained. A plurality of straight lines as described above are drawn at the interval of 10 μm, and the distance between the alloy grain boundary phases is obtained by the same method as described above. Then, the distances between the alloy grain boundary phases obtained at each of the straight lines are averaged, and the average value is set to the distance of the alloy grain boundary phases of one sectional surface.

In one alloy, the distances between the alloy grain boundary phases of five sectional surfaces are measured, and the distances between the alloy grain boundary phases of the five sectional surfaces are averaged, and the average value is set to the distance of the alloy grain boundary phases.

In the manufacturing method of an R-T-B-based alloy of the present invention, steps which are generally performed can be suitably performed.

Manufacturing Method of Magnet Using R-T-B-Based Alloy

A manufacturing method of an R-T-B-based rare earth sintered magnet of an embodiment of the present invention includes a casting step of casting a molten alloy formed of a rare earth element R, a transition metal T containing Fe as a main component, a metal element M containing one or more types of metals selected from Al, Ga, and Cu, B and inevitable impurities, in which 13 at % to 16 at % of R is contained, 4.5 at % to 6.2 at % of B is contained, 0.1 at % to 2.4 at % of M is contained, the balance is T and the inevitable impurities, a proportion of Dy in the entire rare earth element is 0 at % to 65 at %, and Formula 1 described below is satisfied, and manufacturing of a cast alloy, a heat treatment step of performing heat treatment with respect to the cast alloy at a temperature of 600° C. to 1000° C., and of manufacturing an alloy for an R-T-B-based rare earth sintered magnet, a pulverizing step of pulverizing the alloy for an R-T-B-based rare earth sintered magnet, a molding step of molding the pulverized alloy for an R-T-B-based rare earth sintered magnet, and of obtaining a molded body, and a sintering step of sintering the molded body.

$$0.30 \leq B/TRE \leq 0.37 \quad \text{(Formula 1)}$$

In Formula 1, B represents a concentration (at %) of a boron element, and TRE represents a total concentration (at %) of the rare earth elements.

In the manufacturing method of an R-T-B-based rare earth sintered magnet of the embodiment of the present invention, a specific example will be described. First, the casting step of casting the molten alloy satisfying the composition described above and Formula 1 described above, and of manufacturing the cast alloy is performed, and then, the heat treatment step is performed with respect to the cast alloy. Therefore, the alloy for an R-T-B-based rare earth sintered magnet is manufactured, and then, the pulverizing step is performed with respect to the alloy.

In the pulverizing step, a cast alloy flake is decrepitated by a hydrogen decrepitation method, and then, is pulverized by a jet mill or the like.

The hydrogen decrepitation method, for example, is performed in the procedure where hydrogen is occluded in the cast alloy flake at room temperature, a heat treatment is performed at a temperature of approximately 300° C. in hydrogen, hydrogen entered between grids of the main phase is degassed by being depressurized, and after that, heat treatment is performed at a temperature of approximately 500° C., and hydrogen combined to the rare earth element in the alloy grain boundary phase is removed. In the hydrogen decrepitation method, the volume of the cast alloy flake in which hydrogen is occluded expands, and thus, a plurality of cracks are easily generated in the alloy, and the cast alloy flake is decrepitated.

Next, the cast alloy flake which has been subjected to hydrogen decrepitation is put into a jet mill pulverizer, and is finely pulverized such that the average particle size becomes 3 μm to 7 μm, for example, by using high pressure nitrogen at 0.6 MPa, and then, becomes a powder.

Next, the molding step is performed. In the molding step, 0.02 mass % to 0.03 mass % of zinc stearate is added to the powder of the R-T-B-based alloy as a lubricant, and press molding is performed in a transverse magnetic field by using a molding machine or the like. After that, sintering was performed in a vacuum (the sintering step), and continuously, the heat treatment is performed. Therefore, an R-T-B-based sintered magnet is obtained.

A sintering temperature is preferably 800° C. to 1200° C., and is more preferably 900° C. to 1200° C.

In addition, the heat treatment after the sintering may be performed one time, or may be performed two or more times. For example, in a case where the heat treatment after the sintering is performed only one time, it is preferable that the heat treatment be performed at 500° C. to 530° C. In addition, in a case where the heat treatment after the sintering is performed two times, it is preferable that the heat treatment be performed at a two-step temperature of a temperature of 600° C. to 950° C. and a temperature of 400° C. to 500° C.

A manufacturing method of an R-T-B-based rare earth sintered magnet of another embodiment of the present invention includes a pulverizing step of pulverizing the alloy for an R-T-B-based rare earth sintered magnet of the present invention described above, a molding step of molding the pulverized alloy for an R-T-B-based rare earth sintered magnet, and of obtaining a molded body, and a sintering step of sintering the molded body. Even in a case where the manufacturing method of an R-T-B-based rare earth sintered magnet is specifically performed, the manufacturing method of an R-T-B-based rare earth sintered magnet can be performed according to the example described above.

EXAMPLES

Here, examples of the present invention will be described, but the present invention is not limited to the examples.

Examples 1 to 4 and Comparative Examples 1 and 2

Nd metal (a purity of greater than or equal to 99 wt %), Pr metal (a purity of greater than or equal to 99 wt %), Dy metal (a purity of greater than or equal to 99 wt %), ferroboron Fe of 80 wt % and B of 20 wt %), liquid iron (a purity of greater than or equal to 99 wt %), Al metal (a purity of greater than or equal to 99 wt %), Ga metal (a purity of greater than or equal to 99 wt %), Cu metal (a purity of 99 wt %), and Co metal (a purity of greater than or equal to 99 wt %) were weighed such that an alloy composition of alloys A to F shown in Table 1 was obtained, and were put into an alumina crucible.

TABLE 1

[Composition: at %]

| | Alloy Name | TRE | Nd | Pr | Dy | Al | Fe | Ga | Cu | Co | B | B/TRE |
|---|---|---|---|---|---|---|---|---|---|---|---|---|
| Example 1 | A | 15.27 | 11.28 | 3.99 | 0.00 | 0.48 | 77.46 | 0.48 | 0.14 | 1.02 | 5.16 | 0.338 |
| Example 2 | B | 15.70 | 11.70 | 4.00 | 0.00 | 0.47 | 77.43 | 0.58 | 0.12 | 0.57 | 5.13 | 0.327 |
| Example 3 | C | 15.79 | 11.50 | 3.87 | 0.42 | 0.50 | 77.31 | 0.59 | 0.12 | 0.55 | 5.14 | 0.326 |
| Example 4 | D | 15.76 | 11.14 | 3.80 | 0.83 | 0.47 | 77.41 | 0.58 | 0.12 | 0.56 | 5.10 | 0.324 |

TABLE 1-continued

[Composition: at %]

| | Alloy Name | TRE | Nd | Pr | Dy | Al | Fe | Ga | Cu | Co | B | B/TRE |
|---|---|---|---|---|---|---|---|---|---|---|---|---|
| Comparative Example 1 | E | 14.76 | 9.68 | 2.99 | 2.09 | 0.44 | 77.59 | 0.00 | 0.11 | 1.01 | 5.85 | 0.396 |
| Comparative Example 2 | F | 15.45 | 11.60 | 3.62 | 0.23 | 0.23 | 75.70 | 0.07 | 0.10 | 2.42 | 5.82 | 0.377 |

After that, the alumina crucible was disposed in a high-frequency vacuum induction furnace, and the inside of the furnace was substituted with Ar. Then, the high-frequency vacuum induction furnace was heated to 1450° C., and the alloy was melted. Therefore, a molten was obtained. After that, the molten was poured into a water-cooling copper roll, and a cast alloy was cast by a strip cast (SC) method. At this time, a circumferential velocity of the water-cooling copper roll was 1.0 m/second, and the average thickness of the molten was approximately 0.3 mm. After that, the obtained cast alloy was taken out, and in an argon atmosphere, the cast alloy was subjected to heat treatment at a predetermined temperature for a predetermined time (the heat treatment step was performed).

After that, the cast alloy which had been subjected to the heat treatment was decrepitated by the following hydrogen decrepitation method. First, a cast alloy flake was coarsely pulverized such that a diameter became approximately 5 mm, and was put into a hydrogen atmosphere at room temperature, and hydrogen was occluded in the cast alloy flake. Subsequently, coarse decrepitation was performed, and heat treatment was performed in which the cast alloy flake storing hydrogen was heated to 300° C. in a hydrogen atmosphere. After that, hydrogen between grids of a main phase was degassed by being depressurized from 300° C., heat treatment of heating the cast alloy flake to 500° C. was further performed, hydrogen in an alloy grain boundary phase was discharged and removed, and cooling to room temperature was performed.

Next, 0.025 wt % of zinc stearate was added to the cast alloy flake which had been subjected to hydrogen decrepitation as a lubricant, and the cast alloy flake which had been subjected to hydrogen decrepitation was finely pulverized such that the average particle size (d50) became 4 μm by using a jet mill (100AFG manufactured by HOSOKAWA MICRON CORPORATION) and high-pressure nitrogen at 0.6 MPa. Therefore, an R-T-B-based alloy powder was obtained.

Next, 0.02 mass % to 0.03 mass % of zinc stearate was added to the R-T-B-based alloy powder obtained as described above as a lubricant, and the R-T-B-based alloy powder was subjected to press molding at a molding pressure of 0.8 t/cm$^2$ in a transverse magnetic field by using a molding machine (a magnetic field of 2T). Therefore, a powder compact was obtained. After that, the obtained powder compact was sintered at a temperature of 900° C. to 1200° C. in a vacuum. After that, heat treatment was performed at a two-step temperature of 800° C. and 500° C., and cooling was performed. Therefore, R-T-B-based magnets of Examples 1 to 4 and Comparative Examples 1 and 2 were prepared.

Next, the obtained R-T-B-based magnets of Examples 1 to 4 and Comparative Examples 1 and 2 were processed into the shape of a cube having one side of 6.5 mm, and each orientation rate was measured by a pulse type BH tracer (TPM2-10 Type Tracer, manufactured by TOEI INDUSTRY CO., LTD.).

Figure 2:
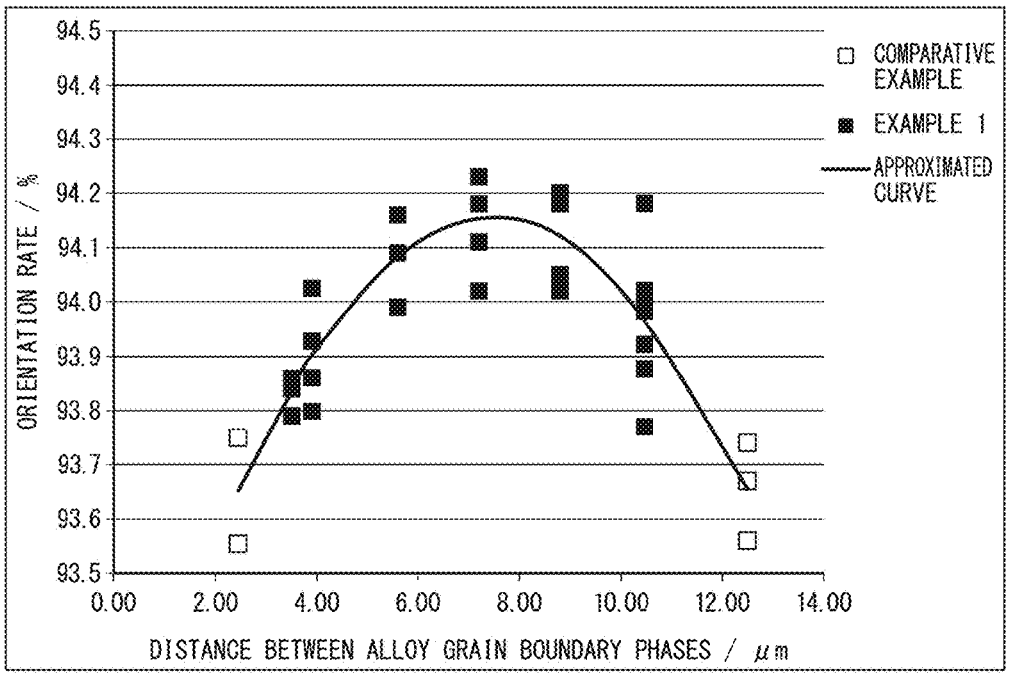
FIG. 2 is a graph illustrating a relationship between a distance between alloy grain boundary phases of an R-T-B-based alloy having a composition of an alloy A obtained by changing heat treatment conditions and an orientation rate of an R-T-B-based magnet manufactured by using the R-T-B-based alloy.

In FIG. 2, a relationship between a distance between alloy grain boundary phases of an R-T-B-based alloy having a composition of an alloy A obtained by changing heat treatment conditions and an orientation rate of an R-T-B-based magnet (Example 1) manufactured by using the R-T-B-based alloy is illustrated. In the graph, a result of an R-T-B-based magnet manufactured by using an R-T-B-based alloy in which the heat treatment step of the present invention is not performed or a result of a magnet having a distance between alloy grain boundary phases not in the range of the present invention is illustrated as a comparative example.

From the graph illustrated in FIG. 2, it was found that the orientation rate depends on the distance between the alloy grain boundary phases. In such an orientation rate depending on the distance between the alloy grain boundary phases, there is no example of a report until now as far as the present inventors know.

In FIG. 2, a plurality of data items of each distance between the alloy grain boundary phases are illustrated, and the average thereof is illustrated as an approximated curve.

In the data in a case where the distance between the alloy grain boundary phases is less than 3 μm (in a case where the heat treatment step of the present invention is not performed), even in a case where the orientation rate is maximized, the orientation rate does not reach 93.8%, and even in a case where the orientation rate is minimized, the orientation rate is less than 93.6%. In the data in a case where the distance between the alloy grain boundary phases is greater than 11 μm, even in a case where the orientation rate is maximized, the orientation rate does not reach 93.8%, and even in a case where the orientation rate is minimized, the orientation rate is less than 93.6%.

In contrast, in the data in a case where the distance between the alloy grain boundary phases is 3 μm to 11 μm, even in a case where the orientation rate is minimized, the orientation rate is greater than or equal to 93.7%, and in the data in a case where the distance between the alloy grain boundary phases is 4.5 μm to 10 μm, even in a case where the orientation rate is minimized, the orientation rate is approximately 94%, and in the data in a case where the distance between the alloy grain boundary phases is 6 μm to 9 μm, even in a case where the orientation rate is minimized, the orientation rate is greater than 94%.

As seen from the approximated curve, in a case where the distance between the alloy grain boundary phases is 3 μm to 11 μm, the orientation rate is greater than or equal to 93.75%, in a case where the distance between the alloy grain boundary phases is 4.5 μm to 10 μm, the orientation rate is greater than or equal to 94.0%, and in a case where the distance between the alloy grain boundary phases is 6 μm to 9 μm, the orientation rate is greater than or equal to 94.1%.

Figure 3:
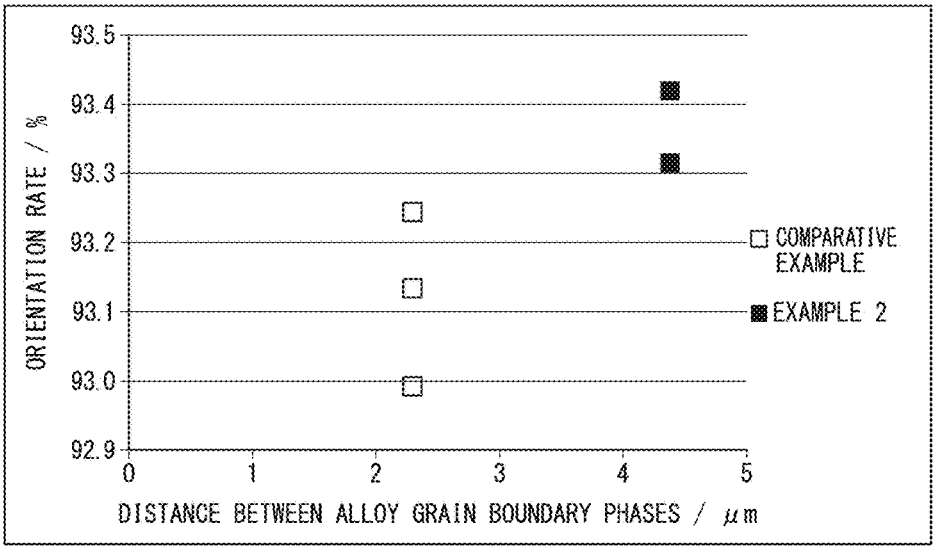
FIG. 3 is a graph illustrating a relationship between a distance between alloy grain boundary phases of an R-T-B-based alloy having a composition of an alloy B and an orientation rate of an R-T-B-based magnet manufactured by using the R-T-B-based alloy.

In FIG. 3, a relationship between a distance between alloy grain boundary phases of an R-T-B-based alloy having a composition of an alloy B and an orientation rate of an R-T-B-based magnet (Example 2) manufactured by using the R-T-B-based alloy is illustrated. In the graph, a result of an R-T-B-based magnet manufactured by using an R-T-B-based alloy in which the heat treatment step of the present invention is not performed is illustrated as a comparative example.

As is apparent from the graph, in the composition of the alloy B, in a case of using an R-T-B-based alloy (the distance between the alloy grain boundary phases is 4.4 μm) in which the heat treatment step is performed with respect to the cast alloy, the orientation rate is improved compared to a case of using the R-T-B-based alloy (the distance between the alloy grain boundary phases is 2.2 μm) in which the heat treatment step is not performed.

Figure 4:
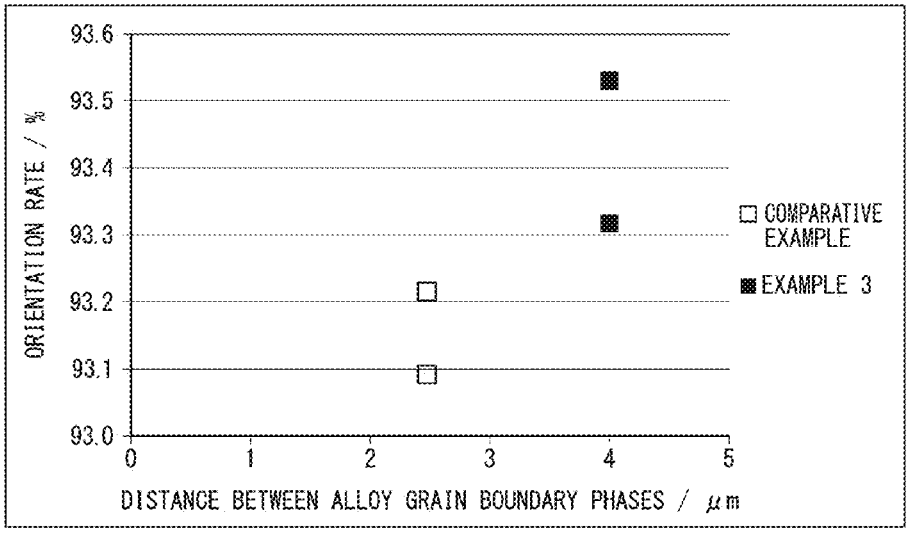
FIG. 4 is a graph illustrating a relationship between a distance between alloy grain boundary phases of an R-T-B-based alloy having a composition of an alloy C and an orientation rate of an R-T-B-based magnet manufactured by using the R-T-B-based alloy.

In FIG. 4, a relationship between a distance between alloy grain boundary phases of an R-T-B-based alloy having a composition of an alloy C and an orientation rate of an R-T-B-based magnet (Example 3) manufactured by using the R-T-B-based alloy is illustrated. In the graph, a result of an R-T-B-based magnet manufactured by using an R-T-B-based alloy in which the heat treatment step of the present invention is not performed is illustrated as a comparative example.

As is apparent from the graph, in the composition of the alloy C, in a case of using an R-T-B-based alloy (the distance between the alloy grain boundary phases is 4.0 μm) in which the heat treatment step is performed with respect to the cast alloy, the orientation rate is improved compared to a case of using the R-T-B-based alloy (the distance between the alloy grain boundary phases is 2.5 μm) in which the heat treatment step is not performed.

Figure 5:
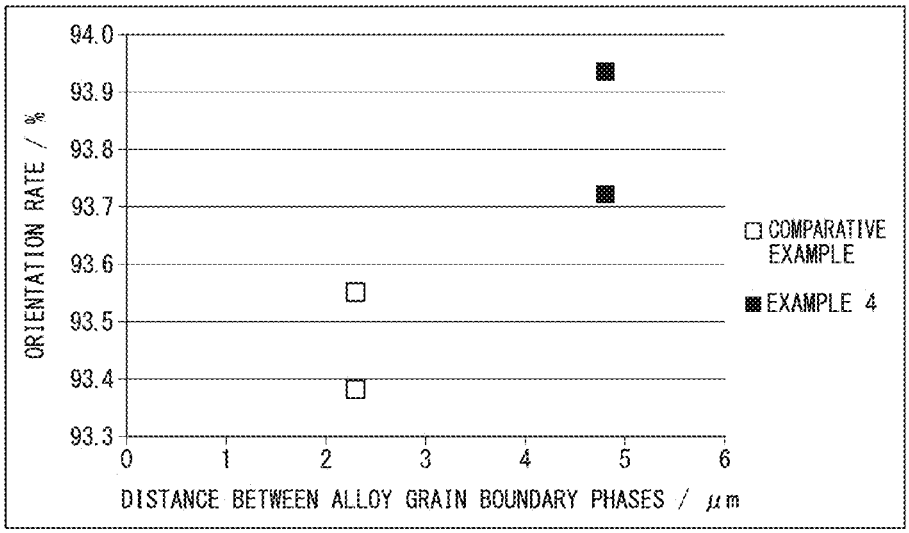
FIG. 5 is a graph illustrating a relationship between a distance between alloy grain boundary rich phases of an R-T-B-based alloy having a composition of an alloy D and an orientation rate of an R-T-B-based magnet manufactured by using the R-T-B-based alloy.

In FIG. 5, a relationship between a distance between alloy grain boundary phases of an R-T-B-based alloy having a composition of an alloy D and an orientation rate of an R-T-B-based magnet (Example 4) manufactured by using the R-T-B-based alloy is illustrated. In the graph, a result of an R-T-B-based magnet manufactured by using an R-T-B-based alloy in which the heat treatment step of the present invention is not performed is illustrated as a comparative example.

As is apparent from the graph, in the composition of the alloy D, in a case of using an R-T-B-based alloy (the distance between the alloy grain boundary phases is 4.9 μm) in which the heat treatment step is performed with respect to the cast alloy, the orientation rate is improved compared to a case of using the R-T-B-based alloy (the distance between the alloy grain boundary phases is 2.2 μm) in which the heat treatment step is not performed.

Figure 6:
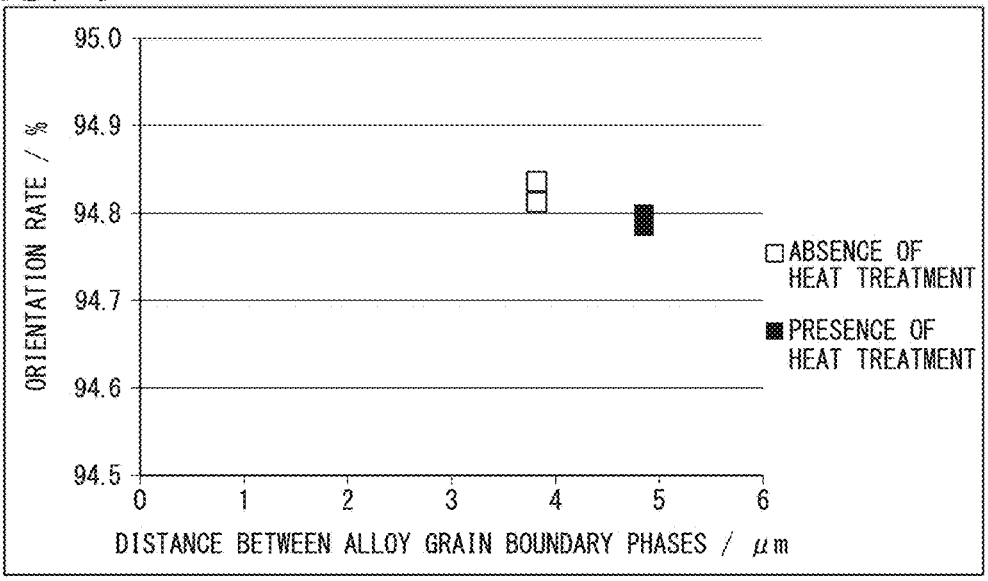
FIG. 6 is a graph illustrating a relationship between a distance between alloy grain boundary phases of an R-T-B-based alloy having a composition of an alloy E and an orientation rate of an R-T-B-based magnet manufactured by using the R-T-B-based alloy.

In FIG. 6, a relationship between a distance between alloy grain boundary phases of an R-T-B-based alloy having a composition of an alloy E which is not in the range of the present invention and an orientation rate of an R-T-B-based magnet (Comparative Example 1) manufactured by using the R-T-B-based alloy is illustrated. In the graph, results of an R-T-B-based magnet manufactured by using an R-T-B-based alloy in which the heat treatment step is performed and an R-T-B-based magnet manufactured by using an R-T-B-based alloy in which the heat treatment step is not performed are illustrated.

In the composition, it was found that the distance between the alloy grain boundary phases was widened by performing the heat treatment step, but the orientation rate was not improved, and in a case where the heat treatment step was performed, the orientation rate slightly decreased.

Figure 7:
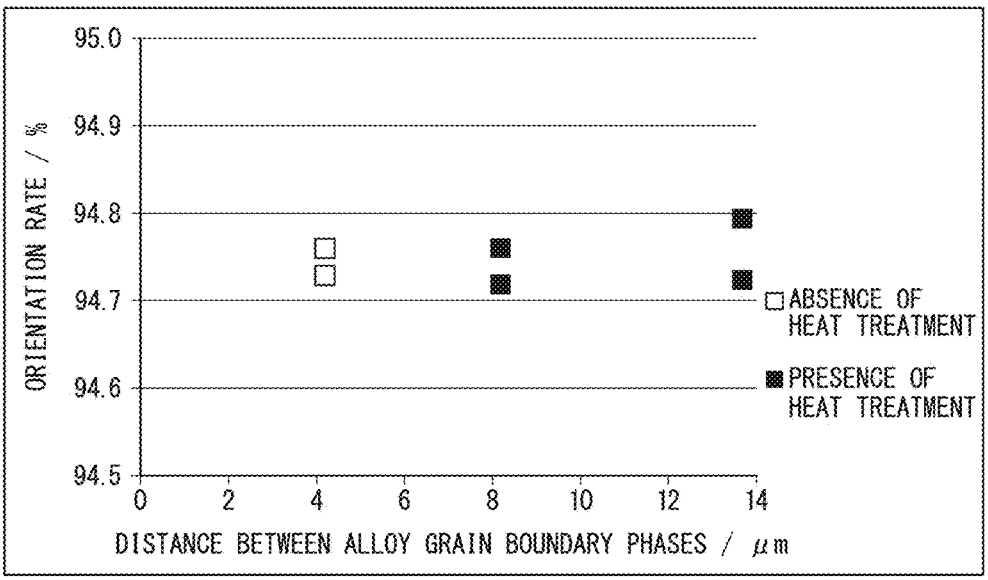
FIG. 7 is a graph illustrating a relationship between a distance between alloy grain boundary phases of an R-T-B-based alloy having a composition of an alloy F and an orientation rate of an R-T-B-based magnet manufactured by using the R-T-B-based alloy.

In FIG. 7, a relationship between a distance between alloy grain boundary phases of an R-T-B-based alloy having a composition of an alloy F which is not in the range of the present invention and an orientation rate of an R-T-B-based magnet (Comparative Example 2) manufactured by using the R-T-B-based alloy is illustrated. In the graph, results of an R-T-B-based magnet manufactured by using an R-T-B-based alloy in which the heat treatment step is performed and an R-T-B-based magnet manufactured by using an R-T-B-based alloy in which the heat treatment step is not performed are illustrated.

In the composition, it was found that the distance between the alloy grain boundary phases was widened by performing the heat treatment step, but the orientation rate was rarely improved.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A R-T-B-based rare earth sintered magnet obtained from an alloy for an R-T-B-based rare earth sintered magnet formed of a rare earth element R, a transition metal T containing Fe as a main component, a metal element M containing one or more metals selected from Al, Ga, and Cu, and B and inevitable impurities, wherein 13 at % to 16 at % of R is contained, 4.5 at % to 6.2 at % of B is contained, 0.1 at % to 2.4 at % of M is contained, the balance is T and the inevitable impurities, a proportion of Dy in the entire rare earth element is 0 at % to 65 at %, Formula 1 described below is satisfied, a main phase containing $R_2T_{14}B$ as a main component and an alloy grain boundary phase containing more R than the main phase are included, a distance between the alloy grain boundary phases is greater than or equal to 4.5 μm and less than or equal to 11 μm, $$0.30 \leq B/TRE \leq 0.37 \quad \text{(Formula 1)}$$

in Formula 1, B represents a concentration (at %) of a boron element, and TRE represents a total concentration (at %) of the rare earth elements, a grain boundary phase formed only of R and an alloy grain boundary phase containing R-T-M substantially exist in the alloy grain boundary phase, and the orientation rate of the R-T-B-based rare earth sintered magnet is greater than or equal to 94.0%.

* * * * *